United States Patent [19]

Boutot et al.

[11] Patent Number: 5,043,628

[45] Date of Patent: Aug. 27, 1991

[54] FAST PHOTOMULTIPLIER TUBE HAVING A HIGH COLLECTION HOMOGENEITY

[75] Inventors: Jean-Pierre Boutot; Pierre L'Hermite, both of Brive, France

[73] Assignee: U.S. Philips Corp., New York, N.Y.

[21] Appl. No.: 497,286

[22] Filed: Mar. 22, 1990

[30] Foreign Application Priority Data

Mar. 24, 1989 [FR] France ..... 89 03930

[51] Int. Cl.[5] ..... H01J 43/20

[52] U.S. Cl. ..... 313/532; 313/528; 313/536; 313/535; 313/103 CM

[58] Field of Search ..... 313/532, 533, 528, 529, 313/536, 537, 535, 103 CM, 105 CM

[56] References Cited

U.S. PATENT DOCUMENTS

| | | | |
|---|---|---|---|
| 4,431,943 | 2/1984 | Faulkner et al. | 313/533 |
| 4,645,918 | 2/1987 | Tsuchiya | 313/528 |
| 4,649,314 | 3/1987 | Eschard | 313/103 CM |
| 4,980,604 | 12/1990 | L'Hermite | 313/533 |

FOREIGN PATENT DOCUMENTS

| | | | |
|---|---|---|---|
| 0095264 | 7/1980 | Japan | 313/536 |
| 0198251 | 8/1988 | Japan | 313/532 |

*Primary Examiner*—Donald J. Yusko
*Assistant Examiner*—N. D. Patel
*Attorney, Agent, or Firm*—William L. Botjer

[57] ABSTRACT

A photomultiplier tube comprising a photocathode (10), focusing electrodes (12, 12') and a fast multiplier structure (20) having a large input surface relative to the photocathode and comprising at least one input dynode (21). According to the invention, said photomultiplier tube comprises, between the photocathode (10) and said focusing multiplier structure (20), a first multiplier stage (30) comprising, in succession and viewed from the assembly consisting of the photocathode (10) and the focusing electrodes (12, 12'), a grid (31), a first multiplier dynode (32) of the apertured-plate type, and an extracting grid (33) having the same pattern as said first multiplier dynode (32), the output of the extracting grid (33) being coupled to said input dynode (21) of the multiplier pattern by means of a focusing electrode (40).

1 Claim, 1 Drawing Sheet

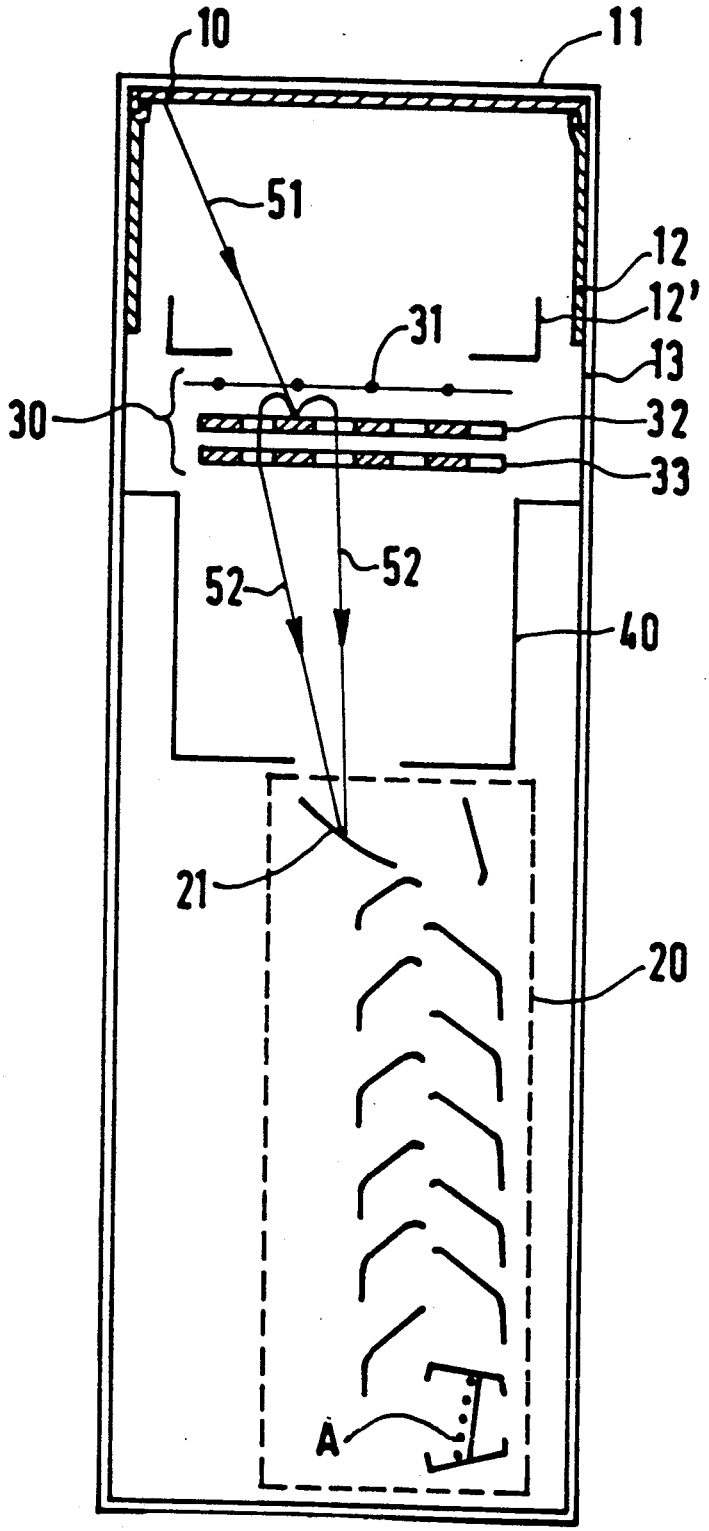
10
11
51
12
12'
31
13
30
32
33
52
52
40
21
20
A

FAST PHOTOMULTIPLIER TUBE HAVING A HIGH COLLECTION HOMOGENEITY

BACKGROUND OF THE INVENTION

The invention relates to a photomultiplier tube comprising a photocathode, focusing electrodes and a focusing multiplier structure having a large input surface relative to the photocathode and comprising at least one input dynode.

The invention can be used in the general technical field of photomultiplier tubes.

The photomultiplier tube as described in the opening paragraph corresponds to a classical type of tubes which are termed "linear focused", as described in, for example, U.S. Pat. No. 3,009,764. The focusing multiplier structure, also termed Rajchmanstructure, comprises, besides the input dynode, a plurality of dynodes which are formed and arranged in such a manner that a progressive focusing of the electron paths along the multiplier structure in ensured. The focusing reduces the difference in transit times between the stages and enables the structure and, hence, the tube to have high operating rates. Besides, the fact that the focused linear tubes have a satisfactory response-linearity as a function of the incident flux can be mainly attributed to the focusing at the various stages.

However, by means of the electron-optical system at the input of the photomultiplier tubes according to the state of the art a collection efficiency of the photoelectrons emitted by the photocathode is obtained which is not constant, because the input dynode of the focusing multiplier structure, i.e., in this case the first dynode of the tube, has a smaller surface than the photocathode and is spaced too far from said photocathode. This results in a certain degree of collection inhomogeneity, so that the electrons issuing from the periphery of the photocathode are not all captured by the input dynode.

SUMMARY OF THE INVENTION

It is an object of the invention to provide a photomultiplier tube comprising a photocathode, focusing electrodes and a focusing multiplier structure having a large input surface relative to the photocathode and comprising at least one input dynode, which tube enables a collection efficiency and a homogeneity which, even in the case of a photocathode having large dimensions, are far better than in the conventional focused linear photomultiplier tubes, while preserving a satisfactory linearity and velocity.

According to the invention, this object is achieved in that said photomultiplier tube comprises, between the photocathode and said focusing multiplier structure, a first multiplier stage comprising, in succession, viewed from the assembly consisting of the photocathode and the focusing electrodes, an accelerating grid, a multiplier dynode of the apertured-plate type, and an extracting grid having the same structure as the multiplier dynode, the output of said extracting grid being coupled to the input dynode of the said multiplier structure by means of a focusing electrode.

The multiplier dynodes of the apertured-plate type and the corresponding extracting grids are known from the state of the art and are used, in general, to form electronmultiplier devices comprising dynodes which can be stacked as described in French Patent Specification No. 2 549 288, which corresponds to U.S. Pat. No. 4,649,314, issued Mar. 10, 1987 or in the unpublished French Patent Application No. 88 09083, which corresponds to U.S. Pat. No. 4,980,604, issued Dec. 25, 1990.

As will be described in more detail hereinafter, the photomultiplier tube according to the invention comprises a large collection surface, the dimensions being related to the dimensions of the first multiplier dynode, and enables, by virtue of the structure of the apertured plate, the photoelectrons which follow a path which is very inclined relative to the first dynode to be collected. This feature provides the advantage that plane or spherical photocathodes having a large surface area can be used, and it provides a better collection homogeneity. Moreover, by virtue of the electron focusing obtained by means of the focusing multiplier structure, the tube according to the invention has a satisfactory linearity and velocity, which can be attributed more particularly to the fact that the distances between the electrons issuing from the centre of the photocathode and the edge of the photocathode are reduced by the plate shape of the first multiplier dynode. Finally, the invention enables the dynodes to be treated "in situ", the first plane dynode at the input of the tube facilitating the deposition of a secondary emission layer, for example of alkaline antimonide, thus improving the signal/noise ratio.

BRIEF DESCRIPTION OF THE DRAWINGS

The invention will be explained in more detail by means of an exemplary embodiment and with reference to the accompanying drawing, in which The figure is a sectional view of a photomultiplier tube according to the invention.

DETAILED DESCRIPTION OF THE PREFERRED EMBODIMENTS

The figure is a sectional view of a photomultiplier tube comprising a photocathode 10, in this case a plane photocathode which is deposited on a window 11, an assembly of focusing electrodes 12 and 12', and focusing multiplier structure 20, which is known per se, and which comprises an input dynode 21 as well as other multiplier dynodes and an output anode A in the form of a grid. By means of the assembly composed of the photocathode 10, the focusing electrode 12 which is formed by depositing aluminium on the inner wall of an envelope 13 of the tube, and one (or a number of) electrode(s) 12' brought at electric potentials, relative to the photocathode, which range between for example 100 V and 2000 V, photoelectrons 51 emitted by the photocathode 10 are attracted and concentrated at the first multiplier stage. As is shown in the figure, the photomultiplier tube comprises between, on the one hand, the assembly of photocathode 10 and focusing electrodes 12 and 12' and, on the other hand, the focusing multiplier structure 20, a first multiplier stage 30 which is composed of three parts, viewed from the focusing electrode 12':

a high-transparency grid 31 which is obtained, for example, by means of metal wires which are at a distance of 1 to 2 mm from each other.

a first electron multiplier dynode 32 which extends parallel to said grid 31 and which is formed of an apertured plate, the said apertures being provided according to a regular plane pattern, as described in French Patent Application No. 88 09083, filed by Applicants and U.S. Pat. No. 4,980,604. The pitch of said regular plane pattern may be equal to or smaller than that of the grid 31, for example 0.65 mm. The first multiplier dynode 32 is at a potential equal to that of the grid 31 or exceeds this by 10 to 30 V. Thus, the electric field between the grid 31 and the first dynode 32 promotes the attraction of the secondary electrons 52 emitted by the first dynode 32 towards the extracting grid 33 after secondary multiplication, an extracting grid 33 which extends parallel to the first multiplier dynode 32 and which also consists of an apertured plate having the same pattern as the first dynode 32, the holes in the extracting grid 33 being located opposite the holes in the first dynode 32. In order to attract the secondary electrons 52 via the two series of holes in the plates 32 and 33, the extracting grid 33 is brought at an electric potential which exceeds that of the first multiplier dynode 32 by 50 to 200 V.

A focusing electrode 40 permits the secondary electrons 52 leaving the extracting grid 33 to be focused on the input dynode 21 of the focusing multiplier structure 20. Said focusing electrode 40 has the shape of a metal cylinder and its potential is close to that of the first multiplier dynode 32 (10 to 20 V higher or lower). The input dynode 21 is brought at a potential which exceeds that of the extracting grid 33 by, for example, 100 to 500 V.

We claim:

1. A photomultiplier tube comprising a photocathode, focusing electrodes and a focusing multiplier structure having a large input surface relative to the photocathode and comprising at least one input dynode, wherein the improvement comprises the photomultiplier tube comprises, between the photocathode and said multiplier structure, a first multiplier stage comprising, in succession, viewed from the assembly consisting of the photocathode and the focusing electrodes, a grid, a multiplier dynode of the apertured-plate type, and an extracting grid having the same pattern as the said multiplier dynode, the output of the extracting grid being coupled to said input dynode of said multiplier pattern by means of a focusing electrode.

* * * * *